US007661485B2

(12) United States Patent
Vögele et al.

(10) Patent No.: US 7,661,485 B2
(45) Date of Patent: Feb. 16, 2010

(54) HAMMER DRILL

(75) Inventors: Roland Vögele, Winnenden (DE); Rainer Kumpf, Ilsfeld (DE)

(73) Assignee: AEG Electric Tools GmbH, Winnenden (DE)

( * ) Notice: Subject to any disclaimer, the term of this patent is extended or adjusted under 35 U.S.C. 154(b) by 0 days.

(21) Appl. No.: 11/941,122

(22) Filed: Nov. 16, 2007

(65) Prior Publication Data

US 2008/0115952 A1 May 22, 2008

(30) Foreign Application Priority Data

Nov. 17, 2006 (DE) ..... 10 2006 054 288

(51) Int. Cl.
*B25D 11/12* (2006.01)

(52) U.S. Cl. ..... 173/109; 173/90; 173/117

(58) Field of Classification Search ..... 173/48, 173/90, 117, 122, 104, 109
See application file for complete search history.

(56) References Cited

U.S. PATENT DOCUMENTS 3,650,336 A * 3/1972 Koehler ..... 173/110
3,908,139 A * 9/1975 Duncan, Jr. ..... 310/50
3,921,729 A * 11/1975 Schmuck ..... 173/14
3,929,195 A * 12/1975 Stiltz et al. ..... 173/109
4,066,136 A * 1/1978 Wanner et al. ..... 173/48
4,114,699 A * 9/1978 Wolf ..... 173/109
4,346,769 A * 8/1982 Simpson ..... 173/118
4,349,074 A * 9/1982 Ince ..... 173/48
4,353,425 A * 10/1982 Simpson ..... 173/109
4,365,962 A * 12/1982 Regelsberger ..... 464/39
4,436,163 A * 3/1984 Simpson ..... 173/117
4,462,467 A * 7/1984 Weingartner ..... 173/105
4,529,044 A * 7/1985 Klueber et al. ..... 173/48
4,669,551 A * 6/1987 Lippacher et al. ..... 173/109
5,565,719 A 10/1996 Kuhlmann
6,209,659 B1 * 4/2001 Blessing ..... 173/201
7,306,049 B2 * 12/2007 Soika et al. ..... 173/49
7,383,895 B2 * 6/2008 Aoki ..... 173/201
2003/0121683 A1 7/2003 Lebisch et al.
2004/0112615 A1 6/2004 Mayr et al.
2006/0137888 A1 * 6/2006 Soika et al. ..... 173/48
2006/0144603 A1 * 7/2006 Arich et al. ..... 173/109
2008/0196915 A1 * 8/2008 Stirm et al. ..... 173/210

FOREIGN PATENT DOCUMENTS

DE 1652683 A1 12/1970
DE 29800248 U1 5/1999
EP 0016771 B1 12/1983
GB 2357724 A 7/2001

* cited by examiner

*Primary Examiner*—Rinaldi I. Rada
*Assistant Examiner*—Gloria R. Weeks
(74) *Attorney, Agent, or Firm*—Gudrun E. Huckett

(57) ABSTRACT

A hammer drill has an electric drive motor having a motor shaft and a tool shaft driven in rotation by the electric drive motor. A hammer action is provided. The tool shaft is driven by a first single-stage gear unit directly by the motor shaft of the electric drive motor. The hammer action is driven by a second single-stage gear unit directly by the motor shaft of the electric drive motor.

7 Claims, 2 Drawing Sheets

HAMMER DRILL

BACKGROUND OF THE INVENTION

The invention relates to a hammer drill comprising an electric drive motor, a tool shaft that is driven in rotation by the drive motor, and a hammer action.

Hammer drills of known configuration for hand-held operation have a drive motor, a tool shaft driven in rotation by the drive motor as well as a hammer action. The drill bit clamped in a chuck is rotated by the tool shaft. The drive motor that drives the tool shaft actuates also the hammer action that exerts axial hammer strokes on the drill bit. When drilling into stone or similar materials, the drill bit produces a drill hole by simultaneous action of the drill bit rotation and the axial hammer strokes.

For generating the combined rotation and hammer stroke action, in hammer drills according to the prior art a second shaft is provided parallel to the tool shaft. The tool shaft is driven via a two-stage gear unit by the drive motor. The drive motor operates by means of a first gear stage the additional shaft that, in turn, drives the tool shaft by means of a second gear stage. The intermediately positioned second shaft serves moreover as a drive for the hammer action.

The parallel arrangement of two shafts, i.e., the tool shaft and the drive shaft of the hammer action, requires significant mounting space. The same holds true also for the two-stage gear. The configuration is large, heavy and cost-intensive.

SUMMARY OF THE INVENTION

It is an object of the present invention to further develop a hammer drill of the aforementioned kind in such a way that its size is reduced.

In accordance with the present invention, this is achieved in that the tool shaft and the hammer action each are directly driven by means of a single-stage gear by the motor shaft of the drive motor.

The arrangement is free of any play, compact, lightweight, and can be produced inexpensively. The driven gear of the tool shaft is positioned near or even on the end of the tool shaft facing the handle. An intermediate gear shaft is no longer required so that the gear housing can be designed to be relatively slim in the area of the tool. This facilitates working with the hammer drill in tight spaces. With a reduced number of parts and in particular a reduced weight, the center of gravity of the hammer drill is moved closer to the handle so that working with the hammer drill is ergonomically improved.

In a preferred further embodiment, a motor axis of the motor shaft and a shaft axis of the tool shaft are arranged angularly relative to one another wherein the angle is within a range of including 60 degrees to including 120 degrees and is in particular approximately 90 degrees, and wherein the single-stage gear between the motor shaft and the tool shaft is an angular gear that is comprised of a pinion of the motor shaft and a ring gear of the tool shaft meshing with the pinion.

The angled arrangement of the motor axis and the shaft axis enables a short configuration. In the angular gear comprising pinion and ring gear, the engine speed of the drive motor can be reduced sufficiently to the desired rotary speed of the tool shaft by means of the gear unit that comprises only a single stage.

Pinion and ring gear can be provided with a suitable bevel shape. Preferably, the pinion of the motor shaft has a spur gearing while the ring gear is embodied as a crown gear. The spur gearing of the pinion, in particular embodied as a straight gearing, can be produced inexpensively. Despite the angled arrangement of the ring gear and the pinion relative to one another, the configuration of the ring gear as a crown gear provides for clean, minimal wear engagement of the meshing teeth. At the same time, the configuration of the pinion with a spur gearing realizes the additional drive for the hammer action by means of the same pinion.

In a preferred embodiment, an axis of rotation of the hammer action is substantially parallel to the axis of the motor wherein the single-stage gear unit between the motor shaft and the hammer action is provided by the spur gear unit. Expediently, the pinion of the motor shaft having the spur gearing is in engagement with the crown gear of the tool shaft as well as with the spur gear of the hammer action. Only a single toothing must be provided on the motor shaft or its pinion. The arrangement saves space and is inexpensive.

In a preferred embodiment the pinion of the motor shaft engages, at the same axial level with respect to the axial direction of the motor shaft, the crown gear of the tool shaft and the spur gear of the hammer action. In particular, the meshing points of the pinion with the ring gear of the tool shaft and with the spur gear of the hammer action are positioned radially opposite one another relative to the axial direction of the motor shaft. The loads that are acting on the pinion and are caused by the ring gear and the oppositely positioned spur gear act symmetrically and essentially free of eccentricities on the motor shaft. The gear units and the motor support are subjected to minimal loads and can therefore be designed to be small, lightweight, and cost efficient.

In an expedient embodiment the drive motor, the tool shaft, and the hammer action are arranged between two housing shells made of plastic material wherein at least one bearing of the motor shaft and at least one bearing of the hammer action are secured in a common bearing bar in particular made of light metal and wherein the bearing bar is secured between the two housing shells. The common bearing bar generates an increased stiffness of the bearing arrangement and thus improves precision of the mutual alignment of the different components. In particular, the precision of the mutual alignment of the motor shaft and the hammer action directly driven by it is improved. For a compact configuration the axial spacing of motor shaft and hammer action can be reduced. Moreover, the required stiffness of the bearing is provided by the bearing bar alone so that for the gear housing a comparatively soft, impact resistant plastic material can be employed. The bearing bar can be inserted together with the remaining parts such as armature, tool shaft, hammer action, electric components or the like into the plastic shells and can be secured between the two shells in a positive-looking or clamping arrangement. Mounting is simple and inexpensive. The number of rejects as a result of faulty assembly are reduced. The service life of the hammer drill is increased.

The hammer action is advantageously a pneumatic hammer action realized by means of a pressure piston driven by an eccentric and a connecting rod.

DESCRIPTION OF THE PREFERRED EMBODIMENTS

Figure 1:
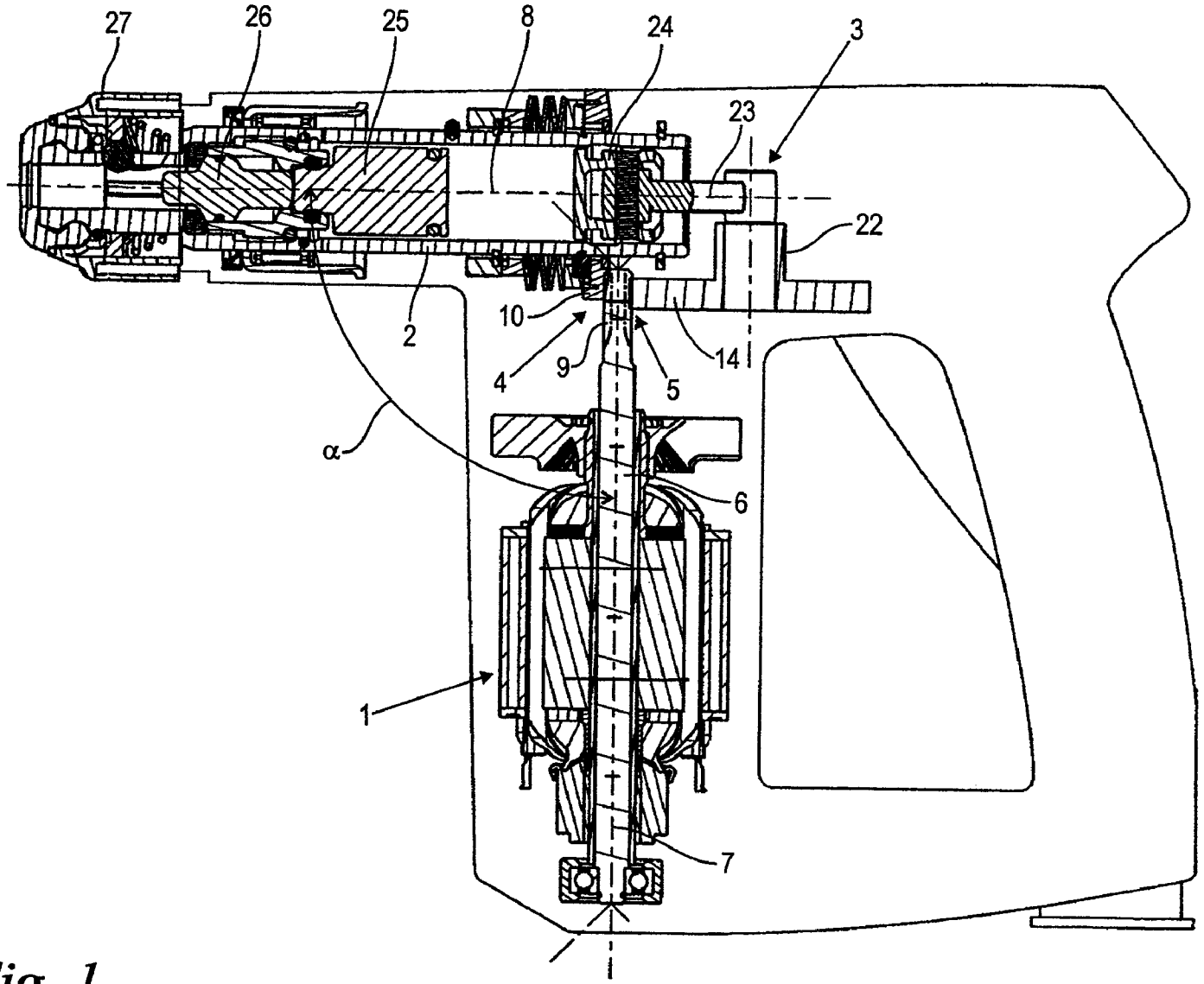
FIG. 1 is a longitudinal section of a hammer drill in accordance with the present invention in an overview illustration of the relative arrangement of drive motor, tool shaft, and hammer action.

FIG. 1 is a longitudinal section view of the hammer drill according to the present invention. The hammer drill has an electric drive motor 1, a tool shaft 2 driven in rotation by the drive motor 1, and a hammer action 3. The electric drive motor 1 is configured to be supplied with electric power from the mains. It may also be expedient to provide battery operation or the like. Instead of electric drive motor 1 is also possible to employ an internal combustion engine.

The hammer drill is shown in its usual operating position in which the operator holds and guides the hammer drill by hand. The shaft axis 8 is positioned approximately horizontally while the motor shaft 6 of the drive motor 1 with its motor axis 7 is arranged approximately vertically. In the illustrated embodiment, the motor axis 7 and the shaft axis 8 are positioned at an angle $\alpha$ of 90 degrees relative to another. The angle $\alpha$ is advantageously within a range of including 60 degrees to including 120 degrees.

The tool shaft 2 is driven directly by the motor shaft 6 of the drive motor 1 by means of a single-stage gear unit 4. A pinion 9 is formed as an integral part of the motor shaft 6 and a ring gear 10 is fixedly connected to the rotatably supported tool shaft 2 at the end facing the handle or in immediate vicinity to said end. Pinion 9 and the ring gear 10 together form a single-stage gear unit in the form of angular gear unit in which the pinion 9 of the motor shaft 6 engages the ring gear 10 of the tool shaft 2 directly. By rotation of the motor shaft 6 the tool shaft 2 is driven in rotation by means of the single-stage gear unit 4 about the shaft axis 8. The single-stage gear unit 4 is a reducing gear in which the operating speed of the drive motor 1 is reduced to a reduced operating speed of the tool shaft 2.

At the free operating end of the tool shaft 2 a chuck 27 for the drill bit is arranged. The chuck 27 is fixedly connected to the tool shaft 2 and transmits the rotational movement of the tool shaft 2 onto the clamped drill bit.

In addition to the gear unit 4, a further single-stage gear unit 5 is provided for directly driving the hammer action 3 by means of the motor shaft 6 of the drive motor 1. For this purpose, the hammer action 3 has an eccentric 22 with an integral spur gear 14 that meshes directly with pinion 9 of the motor shaft 6. The single-stage gear unit 5 between the motor shaft 6 and the hammer action 3 is a reducing spur gear unit that is comprised of the pinion 9 and the spur gear 14.

The tool shaft 2 is embodied as a hollow tube in which, to the rear of the chuck 27, a plunger 26, a header 25, and a pressure piston 24 are guided so as to be longitudinally slidable in the direction of the shaft axis 8. The hammer action 3 is a pneumatic hammer action in which the pressure piston 24 is configured to carry out an oscillating movement in the direction of the shaft axis 8 by means of a connecting rod 23 acted upon by the rotatingly driven eccentric 22. By means of an air cushion in the hollow tool shaft, this oscillating movement is transmitted onto the header 25 that, when striking the plunger 26, transmits the kinetic impact energy through the plunger 26 onto the clamped drill bit (illustrated). The striking movement and the rotational movement of the drill bit are generated by the two single-stage gear units 4, 5 directly via the common pinion 9 of the drive motor 1.

Figure 2:
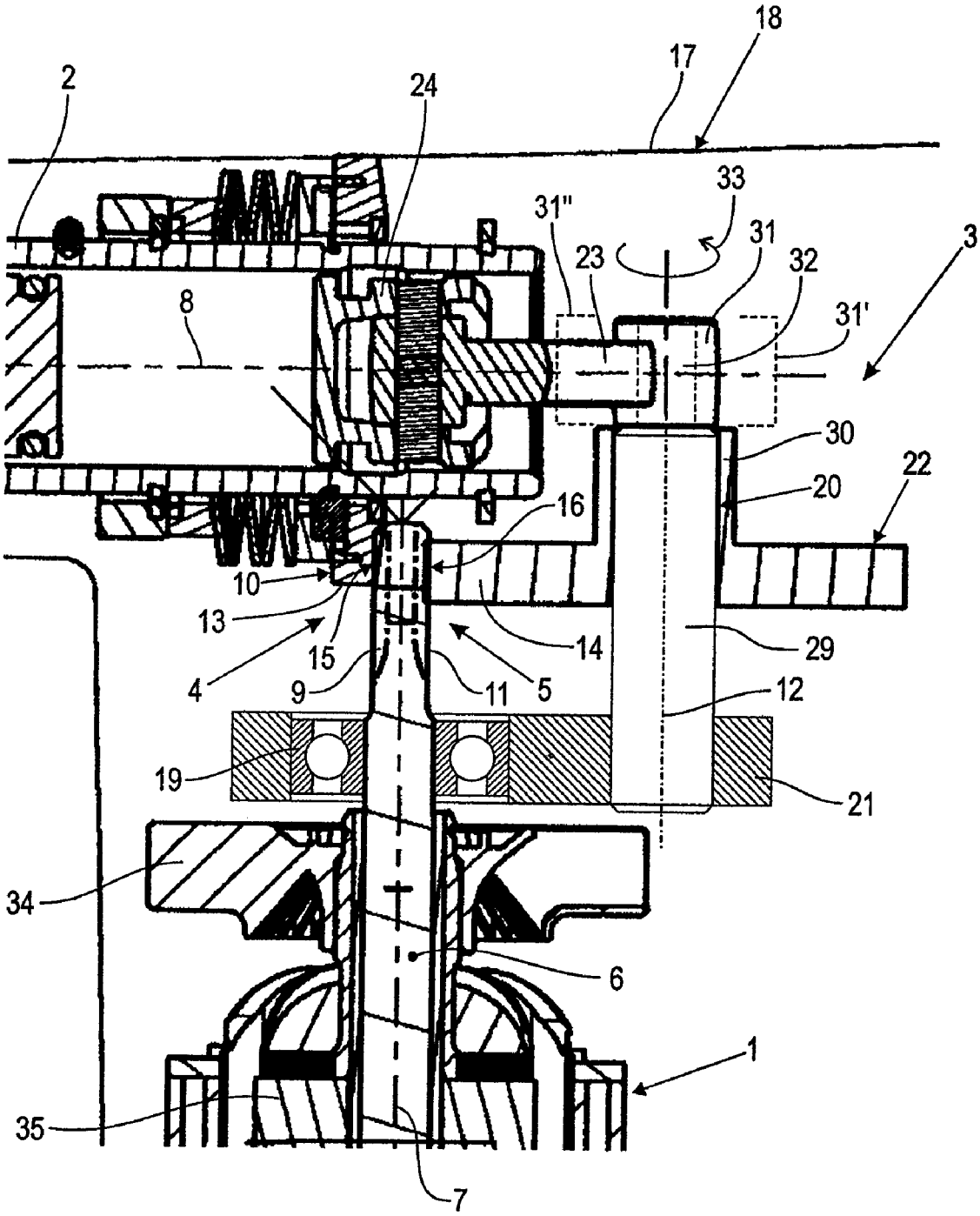
FIG. 2 is a detail view of the arrangement according to FIG. 1 in a drive area of the tool shaft and of the hammer drill with details of the single-stage gear units, respectively.

FIG. 2 shows a detail view of the arrangement according to FIG. 1 in the area of the two gear units 4, 5. It can be seen that the pinion 9 has a spur gearing 11 extending continuously all the way to the free end that is a straight gearing in the illustrated embodiment. It can also be expedient to employ a helical gearing. The ring gear 10 of the tool shaft 2 is embodied as a crown gear 13 whose teeth engage the spur gearing 11 at a meshing point 15. Alternatively, it can also be expedient to configure the pinion 9 in the area of the meshing point 15 as a bevel pinion wherein the ring gear 10 is then embodied in a suitable way as a bevel gear. The meshing point 15 is positioned on the side of the motor shaft 6 facing the chuck 27 (FIG. 1).

The spur gear 14 has at its circumference a straight gearing, not illustrated in detail, that engages at the meshing point 16 the spur gearing 11 of the pinion 9. The diameter and the number of teeth of the spur gear 14 are multiples of the diameter and teeth of the pinion 9 so that the gear unit 5 is a reducing gear for reducing the operating speed of the drive motor 1 to a reduced driving speed of the hammer action 3.

The hammer action 3 including its eccentric 22 with the integral spur gear 14 is arranged on the side of the motor shaft 6 facing away from the chuck 27 in such a way that the meshing point 16 relative to the axial direction of the motor axis 7 is positioned at the same axial level as the meshing point 15 of the gear unit 4. The two meshing points 15, 16 of the two single-stage gear units 4, 5 are positioned opposite one another relative to the motor axis 7. The spur gearing 11 is positioned in engagement with the crown gear 13 at the meshing point 15 as well as in engagement with the spur gear 14 at the meshing point 16.

An embodiment can also be expedient in which the pinion 9 has a spur gearing 11 at the lower area and bevel gearing in the upper area near the free end. In this case, the meshing point 15 of the ring gear 10 embodied as crown gear is above the meshing point 16 of the spur gear 14.

On the eccentric 22 a hub 30 is integrally provided with which the eccentric 22 is supported rotatingly on the bearing pin 29 so as to form a bearing 20. A central axis of the bearing pin 29 forms an axis of rotation 12 of the hammer action 3 that is positioned parallel to the motor axis 7 of the motor shaft 6. The eccentric 22 supports a schematically indicated crank pin 32 that engages the connecting rod eye 31 of the connecting rod 23. When the eccentric 22 is driven in rotation by the drive motor 1 about the axis of rotation 12, the crank pin 32 moves on a circular movement path in accordance with arrow 33. Relative to the axial direction of the shaft axis 8 the connecting rod eye 31 is subjected to an oscillating movement between two end positions identified at 31' and 31". The oscillating movement is transmitted by means of the connecting rod 23 onto the pressure piston 24 that carries out a corresponding axial movement that is transmitted onto the header 25 (FIG. 1).

The entire assembly of the drive motor 1, the tool shaft 2, the hammer action 3 and further components, not explained in detail, are arranged in a machine housing that is comprised of two housing shells 17, 18 made of plastic material. In order not to convolute the illustration, only a section of an open housing shell 17 is shown while a second housing shell 18 that is essentially symmetrical to the first one closes off the arrangement. In the mounted state of the two housing shells 17, 18, a schematically indicated bearing bar 21 of metal is fixedly secured between these shells by form-locking or clamping; advantageously, the bar 21 is made of light metal and in particular of aluminum. The drive motor 1 configured as an electric motor has on its motor shaft 6 an armature 35 having attached to the end face facing the gear units 4, 5 a fan 34 for common rotation with the armature 35. The bearing bar 21 is arranged on the side of the fan 34 facing the gear units 4, 5. The bearing bar 21 supports the bearing pin 29 of the bearing 20 of the hammer action 3. Moreover, a bearing 19 configured as a roller bearing is provided for supporting the motor shaft 6 near the pinion 9; the bearing 19 is also secured in the bearing bar 21. Making the bearing bar 21 from light metal ensures a stable and precise fixation of the bearings 19, 20 relative to one another at a minimal radial spacing between them. It can also be expedient to secure on the bearing bar 21 a bearing of the tool shaft 2 near the gear units and/or an axial contact shoulder of the crown gear 13.

The specification incorporates by reference the entire disclosure of German priority document 10 2006 054 288.6 having a filing date of Nov. 17, 2006.

While specific embodiments of the invention have been shown and described in detail to illustrate the inventive principles, it will be understood that the invention may be embodied otherwise without departing from such principles.

What is claimed is:

1. A hammer drill comprising:

an electric drive motor having a motor shaft;

a tool shaft driven in rotation by the electric drive motor;

a hammer action;

wherein the tool shaft is driven by a first single-stage gear unit directly by the motor shaft of the electric drive motor and wherein the hammer action is driven by a second single-stage gear unit directly by the motor shaft of the electric drive motor;

wherein the first single-stage gear unit connecting the motor shaft and the tool shaft is an angular gear unit and is comprised of a pinion, disposed on the motor shaft and provided with a spur gearing, and further comprised of a crown gear, disposed on the tool shaft and meshing with the pinion;

wherein an axis of rotation of the hammer action is substantially parallel to the motor shaft and wherein the second single-stage gear unit connecting the motor shaft and the hammer action is a spur gear unit; and wherein the spur gearing of the pinion meshes with the crown gear and also a spur gear of the spur gear unit of the hammer action.

2. The hammer drill according to claim 1, wherein a motor axis of the motor shaft and a shaft axis of the tool shaft are positioned at an angle relative to one another, wherein said angle is in a range from including 60 degrees to including 120 degrees.

3. The hammer drill according to claim 1, wherein the spur gearing of the pinion is a straight gearing.

4. The hammer drill according to claim 1, wherein the pinion of the motor shaft, relative to an axial direction of the motor shaft, engages the crown gear of the motor shaft and the spur gear of the hammer action at the same axial level.

5. The hammer drill according to claim 1, wherein a meshing point of the pinion and the crown gear and a meshing point of the pinion and the spur gear of the hammer action are positioned radially opposed to one another relative to an axial direction of the motor shaft.

6. The hammer drill according to claim 1, comprising a housing comprised of two plastic housing shells, wherein the drive motor, the motor shaft and the hammer action are arranged between the two housing shells, wherein at least one bearing of the motor shaft and at least one bearing of the hammer action are secured on a common bearing bar made of light metal and wherein the bearing bar is fixedly secured between the two housing shells.

7. The hammer drill according to claim 1, wherein the hammer action is a pneumatic hammer action comprising a pressure piston and an eccentric driven by the motor shaft, wherein an oscillating movement of the eccentric is transmitted by a connecting rod connected to the eccentric onto the pressure piston.

* * * * *